US006435376B1

(12) United States Patent
Meshberg

(10) Patent No.: US 6,435,376 B1
(45) Date of Patent: Aug. 20, 2002

(54) CONTAINER WITH SNAP-ON NECK

(75) Inventor: Philip Meshberg, Palm Beach, FL (US)

(73) Assignee: Dispensing Patents International LLC., Boynton Beach, FL (US)

( * ) Notice: Subject to any disclaimer, the term of this patent is extended or adjusted under 35 U.S.C. 154(b) by 0 days.

(21) Appl. No.: 09/502,767

(22) Filed: Feb. 11, 2000

Related U.S. Application Data

(60) Continuation-in-part of application No. 08/947,460, filed on Oct. 17, 1997, now Pat. No. 6,126,042, which is a continuation-in-part of application No. 08/774,338, filed on Dec. 30, 1996, now Pat. No. 5,875,932, which is a division of application No. 08/419,499, filed on Apr. 10, 1995, now Pat. No. 5,620,113, which is a continuation-in-part of application No. 08/305,637, filed on Sep. 14, 1994, now Pat. No. 5,667,104, which is a continuation-in-part of application No. 08/222,975, filed on Apr. 5, 1994, now Pat. No. 5,460,207, which is a continuation-in-part of application No. 08/163,787, filed on Dec. 9, 1993, now Pat. No. 5,593,064, which is a division of application No. 07/887,032, filed on May 22, 1992, now Pat. No. 5,305,810.

(51) Int. Cl.[7] ..... B65D 88/54

(52) U.S. Cl. ..... 222/321.7; 222/321.9; 222/321.4; 222/570

(58) Field of Search ..... 222/570, 321.4, 222/321.9, 321.7

(56) References Cited

U.S. PATENT DOCUMENTS

| | | | | | |
|---|---|---|---|---|---|
| 2,582,721 | A | * | 1/1952 | Roshkind | 215/43 |
| 2,670,885 | A | * | 3/1954 | Allen | 222/569 |
| 2,814,404 | A | * | 11/1957 | Towns | 215/41 |
| 3,216,630 | A | * | 11/1965 | Stull | 222/499 |
| 3,454,177 | A | * | 7/1969 | Bloom | 215/6 |
| 3,589,983 | A | * | 6/1971 | Holderith et al. | 195/139 |
| 3,677,430 | A | * | 7/1972 | Yates, Jr. | 215/41 |
| 4,228,931 | A | * | 10/1980 | Ruscitti et al. | 222/321 |
| 4,844,273 | A | * | 7/1989 | Hawkins | 215/329 |
| 5,301,852 | A | * | 4/1994 | Mancini | 222/321 |
| 5,363,993 | A | * | 11/1994 | Mascitelli | 222/321 |

* cited by examiner

*Primary Examiner*—Lesley D. Morris
*Assistant Examiner*—Frederick C. Nicolas
(74) *Attorney, Agent, or Firm*—Kenyon & Kenyon

(57) ABSTRACT

An integrally formed container for complementary use with a mounting cup comprising a neck portion including an interior sealing surface adapted to contact an interior piston portion of a mounting cup and an exterior surface including a lower snap surface adapted to engage the upper snap surface of an exterior snap flange on the mounting cup and a rim surface forming a mouth and disposed between the interior sealing surface of said neck portion and the exterior surface of said neck portion.

11 Claims, 5 Drawing Sheets

CONTAINER WITH SNAP-ON NECK

This application is a continuation-in-part of U.S. patent application Ser. No. 08/947,460, filed Oct. 17, 1997 now U.S. Pat. No. 6,126,042 which is a continuation-in-part of U.S. Pat. application Ser. No. 08/774,338, filed Dec. 30, 1996, now U.S. Pat. No. 5,875,932, which is a division of U.S. patent application Ser. No. 08/419,499, filed Apr. 10, 1995, now U.S. Pat. No. 5,620,113, issued Apr. 15, 1997, which is a continuation-in-part of Ser. No. 08/305,637 filed Sep. 14, 1994, now U.S. Pat. No. 5,667,104, which is a continuation-in-part of Ser. No. 08/222,975 filed Apr. 5, 1994, now U.S. Pat. No. 5,460,207, which is a continuation-in-part of Ser. No. 08/163,787 filed Dec. 9, 1993, now U.S. Pat. No. 5,593,064, which is a division of Ser. No. 07/887, 032 filed May 22, 1992, now U.S. Pat. No. 5,305,810.

BACKGROUND OF THE INVENTION

1. Field of the Invention

The present invention relates to a container with a snap-on neck to be used in a dispensing package.

The container is adapted for use in a package which includes a mounting cup for mounting a pump to the container, which may be blow-molded, without the need for screw threads or crimping. The relationship between the container and the mounting cup forms an effective seal.

2. Description of the Prior Art

U.S. Pat. No. 4,228,931 discloses manually operated pump for use with a container. The container includes a mouth with an outwardly connecting annual rib. The container is used with a head having an inwardly projecting annular rib. The inwardly projecting annular rib of the head is snap connected to the outwardly projecting rib of the container. In the device disclosed in U.S. Pat. No. 4,228,931, when the container and head engage, the rim of the container does not contact the head. Moreover, the surface of the rim and the interior of the container with which it engages are not substantially parallel to each other. Accordingly, in the device of U.S. Pat. No. 4,228,931, the interface between the container and the head fails to form an effective seal.

SUMMARY OF INVENTION

Embodiments of the present invention are directed to an integrally formed container for complementary use with a mounting cup. The container includes an neck portion with an interior sealing surface adapted to contact an interior piston portion of a mounting cup. The neck portion also has an exterior surface including a lower snap surface adapted to engage the upper snap surface of an exterior snap flange on the mounting cup. A rim surface forming a mouth and disposed between the interior sealing surface of said neck portion and the exterior surface of said neck portion terminates the neck portion.

DETAILED DESCRIPTION

Figure 1:
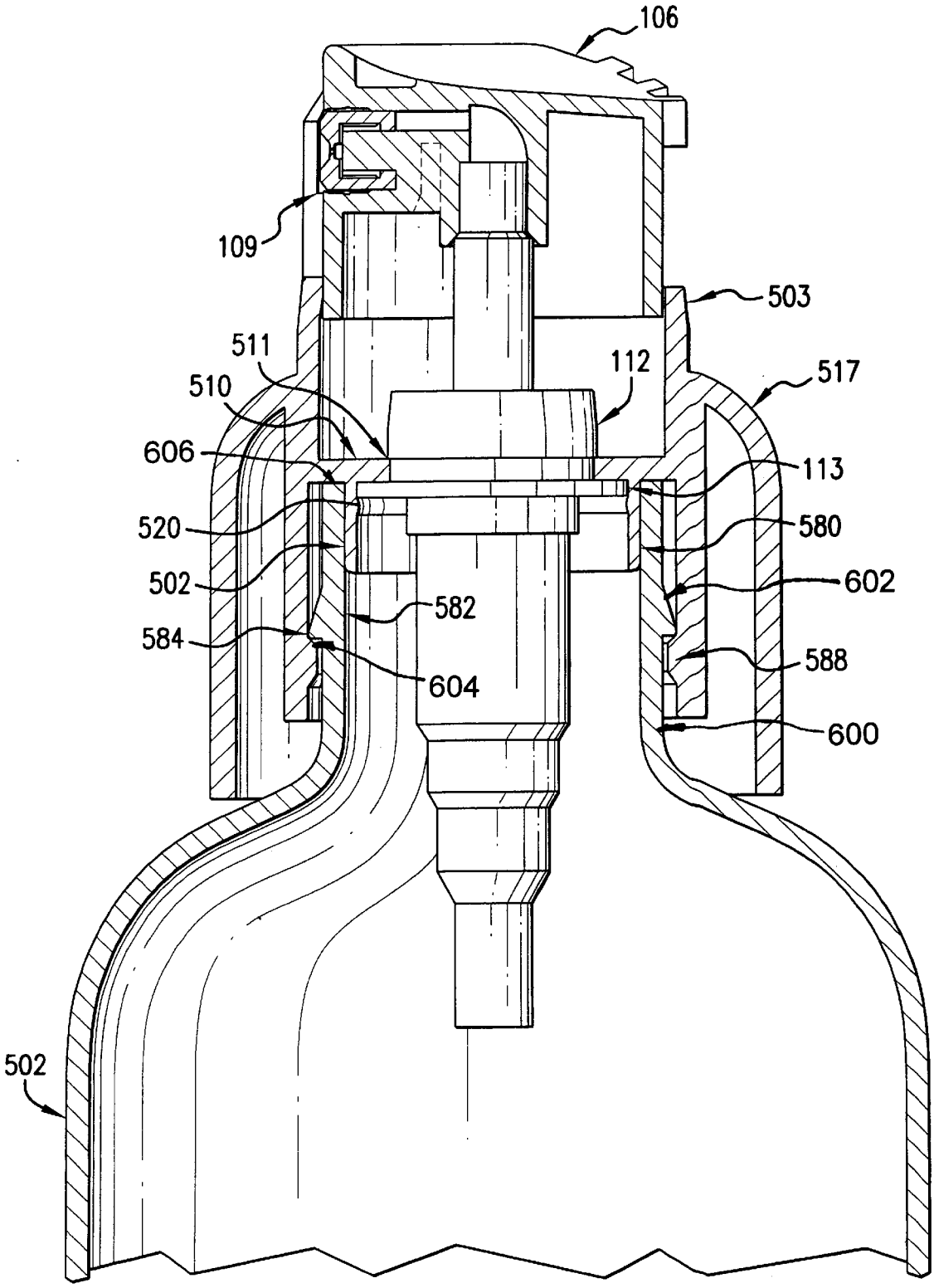
FIG. 1 is a partial cross-sectional view of an embodiment of a container of the present invention.
Figure 2:
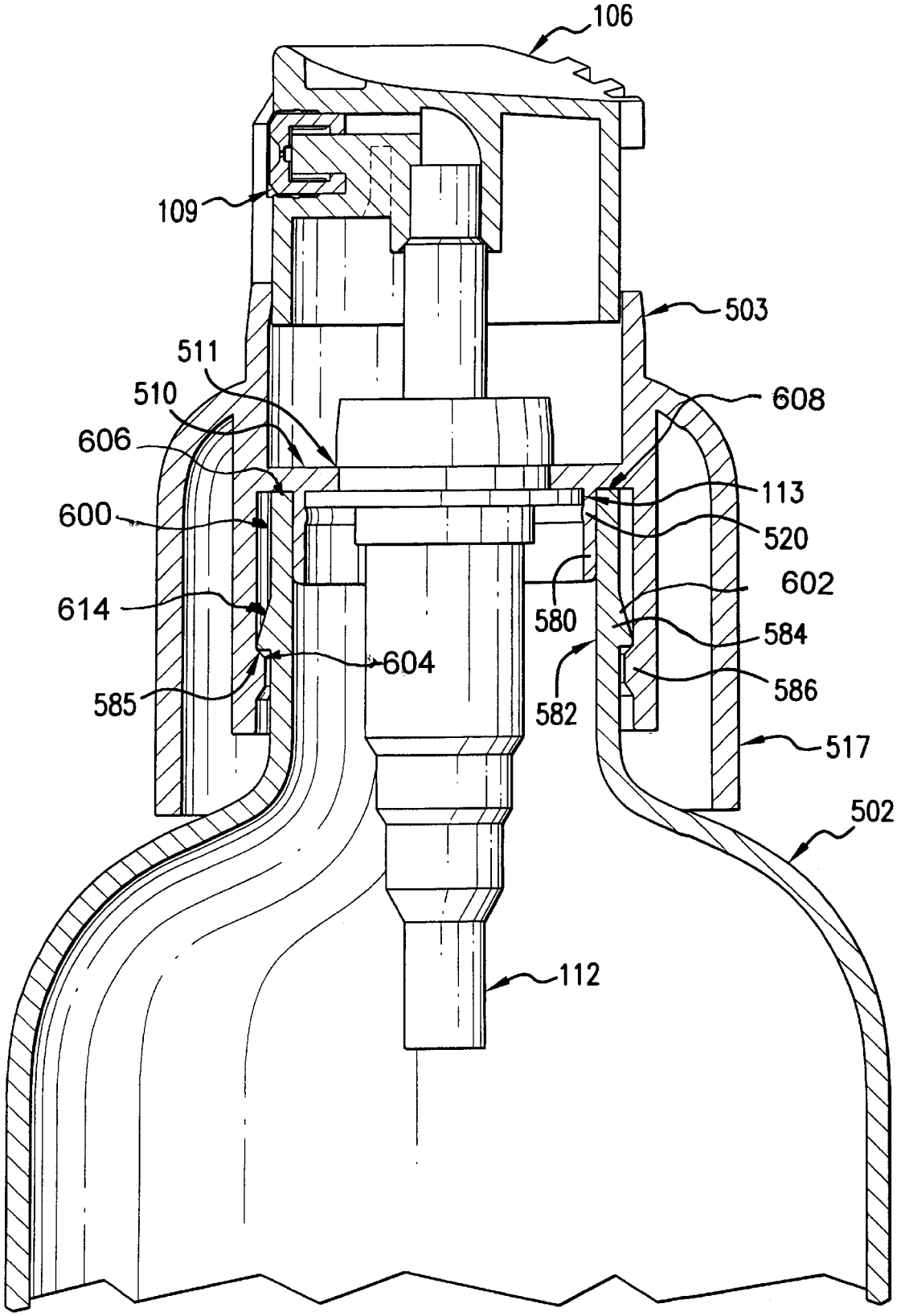
FIG. 2 is a partial cross-sectional detail view of the embodiment of FIG. 8.
Figure 3:
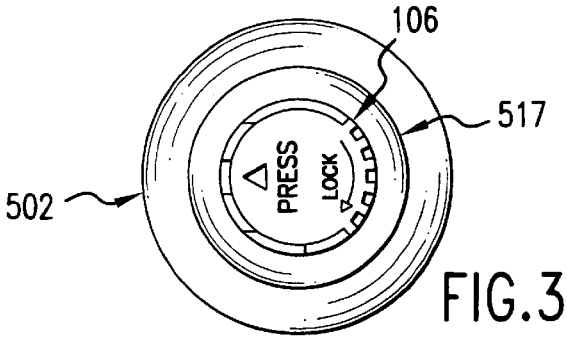
FIGS. 3–6 are, respectively, top, front, side and rear views of the embodiment of FIG. 8.
Figure 4:
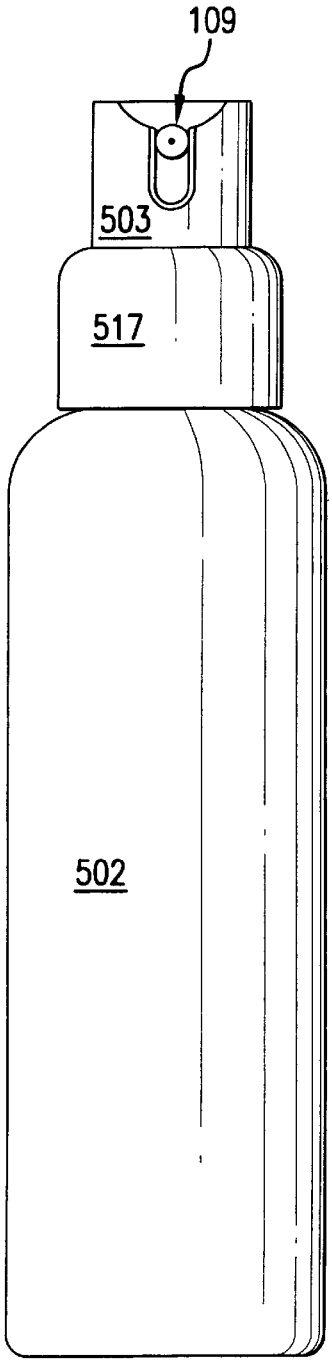
Figure 5:
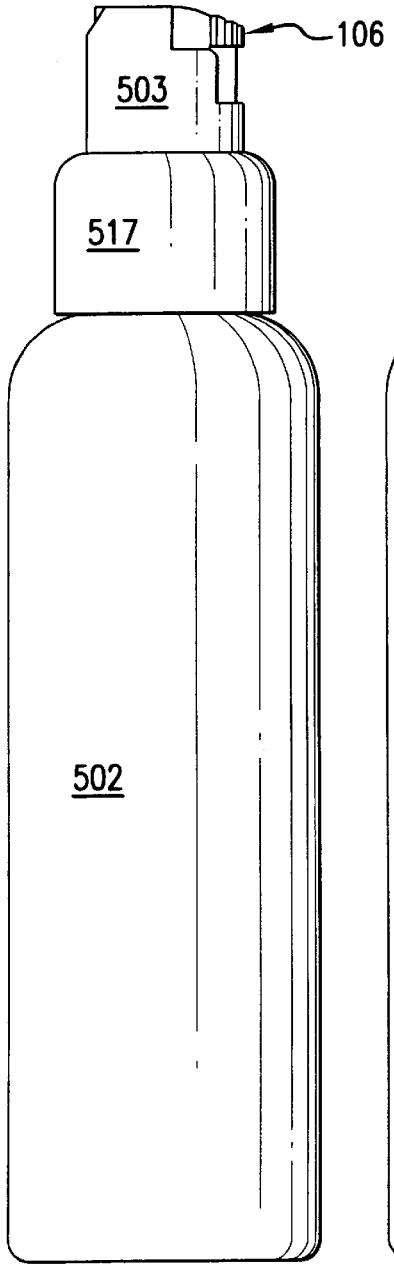
Figure 6:
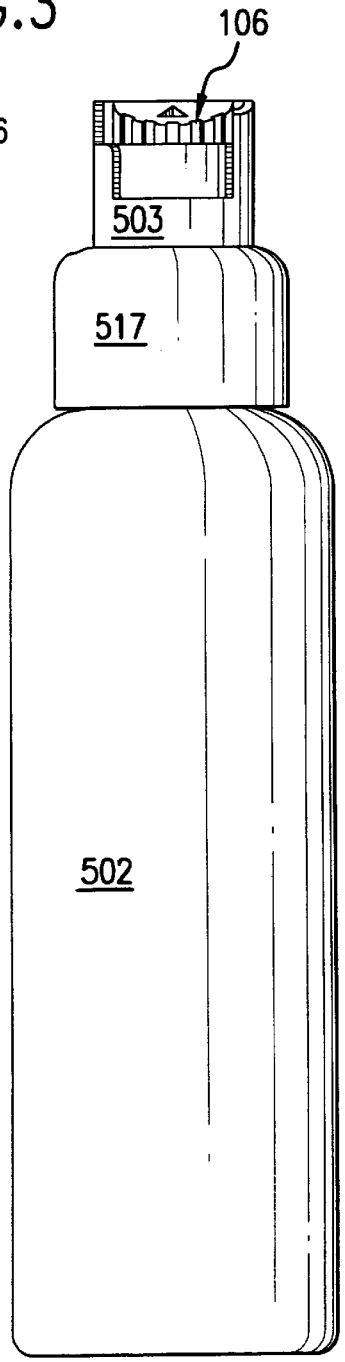

FIGS. 1–9 show an embodiment of the present invention. Shown is a dispensing package 501 with an integrally formed container or bottle 502 for complementary use with a mounting cup 503. The container 502 has a neck portion 600 including an interior sealing surface 582 adapted to contact an interior piston portion 580 of a mounting cup 517. Neck portion 600 also has an exterior surface 602 including a lower snap surface 585 of a snap rim 584 adapted to engage the upper snap surface 604 of an exterior snap flange 586 on the mounting cup 517. Neck portion 600 terminates in a rim surface 606 forming a mouth and disposed between the interior sealing surface 582 of the neck portion and the exterior surface 602 of the neck portion 600.

Figure 7:
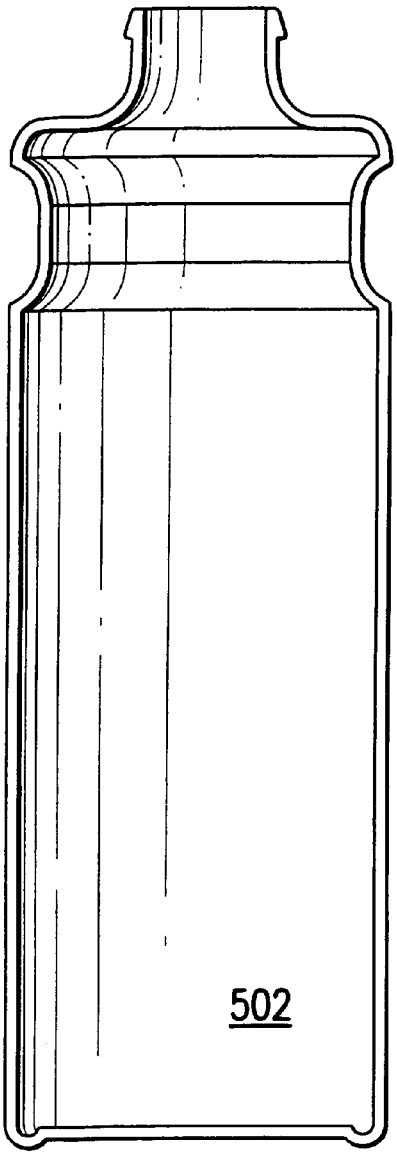
FIGS. 7–8 are, respectively, the cross-sectional and side views of the bottle illustrated in FIG. 9. the dimensions are exemplary.
Figure 8:
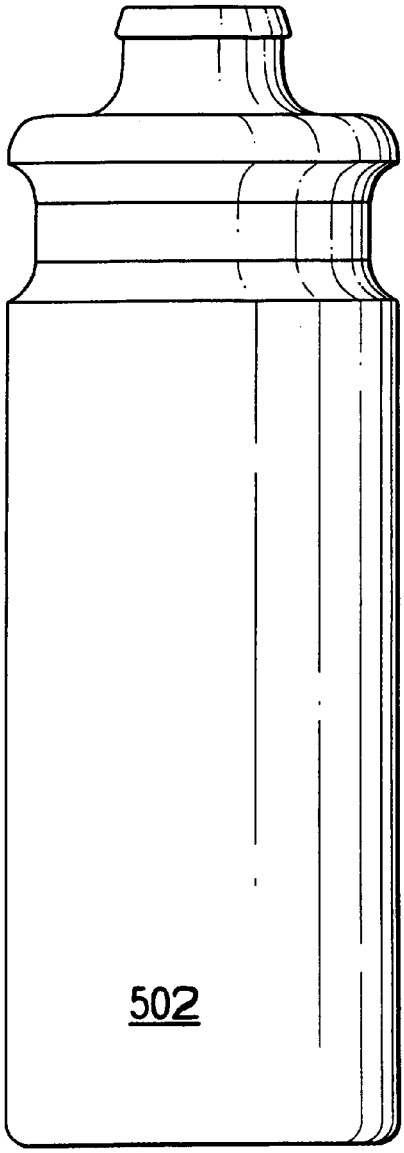
Figure 9:
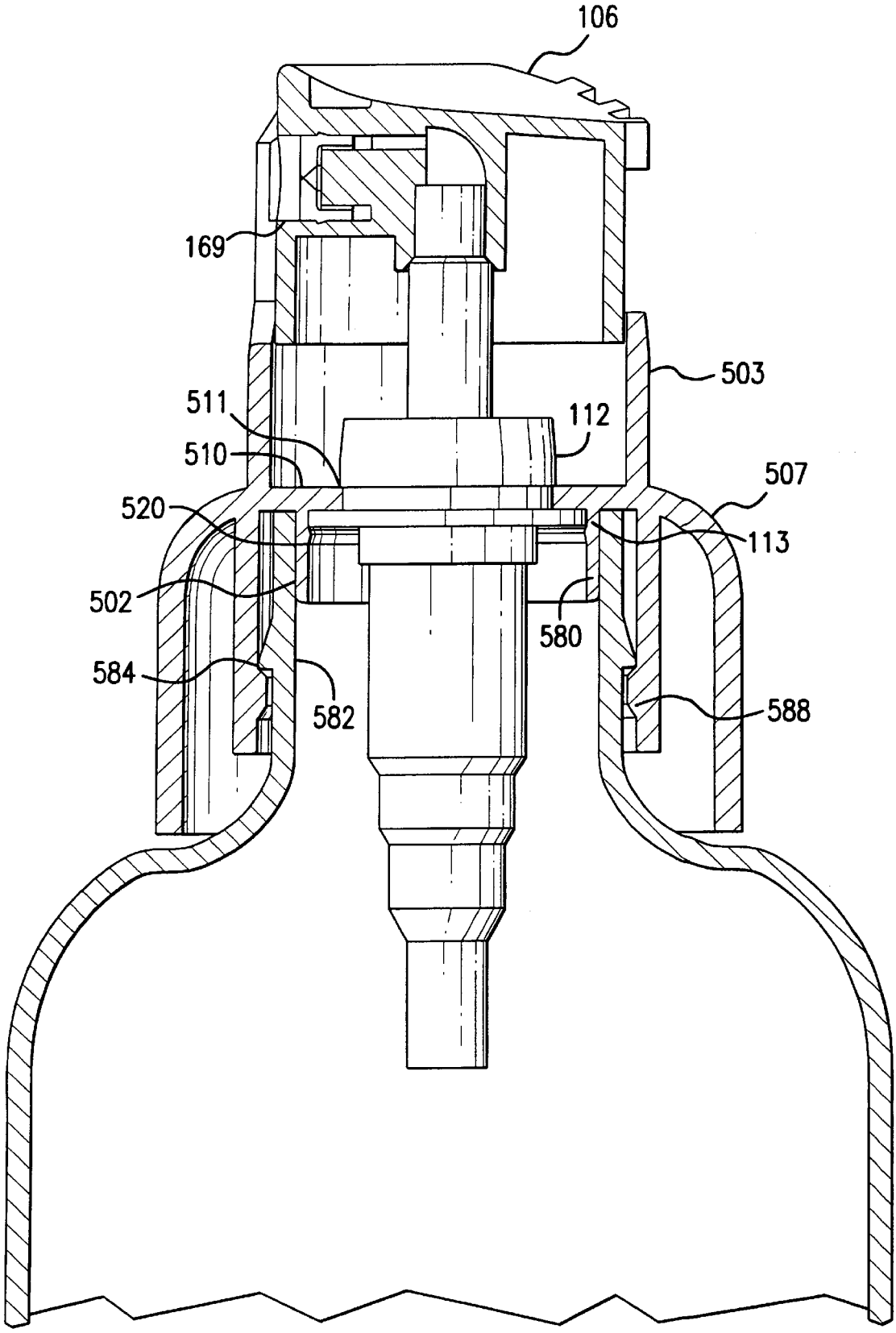
FIG. 9 is a corresponding view of FIG. 8 illustrating exemplary dimensions that result in effective sealing.

The embodiment of FIGS. 1–6, in particular has a small container portion 502 and is especially suitable for promotional purposes however, the present invention is also useful for larger-size bottles or containers such as those shown in FIGS. 7 and 8 in which the container portion 502 of the package 501 may be made by manufacturing techniques other than injection molding, such as blow-molding.

The illustrated embodiments of FIGS. 1–6 and 9 illustrate mounting cup 517 which is used for mounting a pump 112 to the upper end of container portion 502. Mounting cup 517 includes a retaining wall 510 including a retaining opening 511 used to secure a pump 112 in the mounting cup 517. Pump 112 can be of any conventional design. Pump 112 includes a retention flange 113 which snaps into a retaining groove between retaining wall 510 and a retaining bead 520 on the interior piston portion 580. Pump 112 is inserted into retaining opening 511 through the lower end of mounting cup 517.

The mounting cup 517 in the embodiment of FIGS. 8–13 is particularly effective in ensuring a leakproof and easy-to-assemble mounting of pump 112 onto container portion 502 without the need for complicated molding of container portion 502. In addition, the design of mounting cup 517 is such that it does not require a gasket between the mounting cup 517 and the container portion 502 or between the pump 112 and the mounting cup 517.

As noted above, mounting cup 517 includes an interior piston portion 580, which slides in and seals against an interior sealing surface 582 of neck portion 600 of container portion 502. This provides an interference fit in which, as illustrated, interior sealing surface 582 is substantially parallel to interior piston portion 580. However, as illustrated on FIG. 9, interior piston portion 580 may be tapered radially outwardly. Thus,the interior sealing surface 582 of the neck portion 600 is adapted to form an angle with the interior piston portion 580 of the mounting cup 517. Preferably, the angle is less than approximately five degrees. In the embodiment illustrated in FIG. 9 the angle is approximately one degree.

As previously indicated, container portion 502 also includes, at its upper end, angled snap rim 584 extending around the entire circumference of container portion 502, and which is axially spaced from the end of the container portion 502 neck. Snap rim 584 includes a lower snap surface 585. Mounting cup 517 includes an exterior snap flange 586 with a lower snap surface 604 which is used to secure and seal mounting cup 517 to container portion 502.

In the illustrated embodiment, a first axial distance, existing between rim surface 606 and the lower snap surface 585 of the exterior surface 602, is greater than a second axial distance, forming the length of the interior piston portion of the mounting cup. In one embodiment, the first distance is substantially between 0.365 and 0.38 inches.

The exterior surface in the illustrated embodiment includes an upper snap surface 614 which forms an angle between the interior sealing surface of said neck portion. This angle may be approximately 15 degrees. Furthermore, in the embodiment illustrated in FIG. 9, the interior sealing surface 582 has a diameter substantially between 0.72 and 0.73 inches and the exterior surface 602 has a diameter substantially between 0.82 and 0.84 inches in the axial portion near the rim surface 606.

The interior piston portion 580 provides sufficient sealing between mounting cup 517 and container portion 502 so as to eliminate the need for a gasket between the container portion 502 and mounting cup 517. The tapering of interior piston portion 580, which causes a slight interference fit, allows good sealing contact between the mounting cup 517 and the container portion 502. Furthermore, the rim surface 606 engages with a surface 608 of the mounting cup disposed between the interior piston portion 580 and the exterior snap flange 586.

In addition, the slight interference fit causes the interior piston portion 580 to be squeezed inwardly upon insertion into container portion 502, thereby more securely holding retention flange 113 in the groove between retaining wall 510 and retaining bead 520. Interior piston portion 580 also causes improved sealing upon increase of pressure in the interior of container portion 502, as the result of pressure acting on the interior circumference of interior piston portion 580.

As shown in FIGS. 1–9, an actuator 106 is mounted on pump 112 and surrounded by an upstanding wall 503 on mounting cup 517. Actuator 106 can include a nozzle 109.

Of course, it will be recognized by those skilled in the art that a variety of variations may be made in the construction of the above invention without departing from the claims. As such, the scope of the above invention is be limited only by the claims appended hereto.

What is claimed is:

1. An apparatus for dispensing spray, comprising:

a mounting cup, including:

an interior piston portion having a radially outward taper, and an exterior snap flange having an upper snap surface; and a container, including:

a neck portion, having:

an interior sealing surface adapted to contact the interior piston portion of the mounting cup in substantially parallel relationship to establish an interference fit substantially along the length of the interior piston portion, and an exterior surface including a snap rim having a lower snap surface adapted to engage the upper snap surface of the exterior snap flange, and a rim surface, disposed between the interior sealing surface and the exterior surface, adapted to engage a lower surface of the mounting cup disposed between the interior piston portion and the exterior snap flange.

2. The apparatus of claim 1, wherein the interior sealing surface is adapted to form an angle with the interior piston portion.

3. The apparatus of claim 2, wherein the angle is less than five degrees.

4. The apparatus of claim 2, wherein the angle is approximately one degree.

5. The container of claim 1, wherein the exterior surface further includes an upper snap surface.

6. The container of claim 5, wherein the upper snap surface forms an angle with the interior sealing surface.

7. The container of claim 6, wherein the angle is approximately 15 degrees.

8. The apparatus of claim 1, wherein a first axial distance, existing between the rim surface and the lower snap surface, is greater than a second axial distance, forming the length of the interior piston portion.

9. The container of claim 8, wherein the first axial distance is substantially between 0.365 and 0.38 inches.

10. The container of claim 1, wherein the interior sealing surface has a diameter substantially between 0.72 and 0.73 inches.

11. The container of claim 1, wherein the exterior surface has a diameter substantially between 0.82 and 0.84 inches in an axial portion near the rim surface.

* * * * *

UNITED STATES PATENT AND TRADEMARK OFFICE

CERTIFICATE OF CORRECTION

PATENT NO. : 6,435,376 B1
DATED : August 20, 2002
INVENTOR(S) : Philip Meshberg

It is certified that error appears in the above-identified patent and that said Letters Patent is hereby corrected as shown below:

Column 2,
Line 64, change “a lower” to -- an upper --.

Signed and Sealed this

Fourth Day of February, 2003

JAMES E. ROGAN
*Director of the United States Patent and Trademark Office*